US010306384B2

(12) United States Patent
Larsen et al.

(10) Patent No.: US 10,306,384 B2
(45) Date of Patent: May 28, 2019

(54) HEARING DEVICE WITH DETACHABLE SPEAKER UNIT

(71) Applicant: OTICON A/S, Smørum (DK)

(72) Inventors: Jan Thor Lunddahl Larsen, Smørum (DK); Franz Treue, Smørum (DK); Bent Severin, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 15/204,398

(22) Filed: Jul. 7, 2016

(65) Prior Publication Data

US 2017/0013374 A1 Jan. 12, 2017

(30) Foreign Application Priority Data

Jul. 9, 2015 (EP) ..... 15175988

(51) Int. Cl.
*H04R 25/00* (2006.01)
*H01R 13/66* (2006.01)

(52) U.S. Cl.
CPC ..... *H04R 25/604* (2013.01); *H04R 25/305* (2013.01); *H04R 25/556* (2013.01); *H04R 25/60* (2013.01); *H01R 13/6658* (2013.01); *H04R 25/70* (2013.01); *H04R 2225/021* (2013.01); *H04R 2420/09* (2013.01)

(58) Field of Classification Search
CPC .... H04R 25/604; H04R 25/556; H04R 25/60; H04R 25/70; H04R 2225/021; H04R 2420/09; H01R 13/6658
USPC ..... 381/328
See application file for complete search history.

(56) References Cited

U.S. PATENT DOCUMENTS

| | | | | |
|---|---|---|---|---|
| 5,210,803 | A | 5/1993 | Martin et al. | |
| 6,859,538 | B1 | 2/2005 | Voltz | |
| 7,016,512 | B1 * | 3/2006 | Feeley | H04R 25/608 381/322 |
| 7,110,562 | B1 * | 9/2006 | Feeley | H04R 25/60 381/322 |
| 10,028,066 | B2 | 7/2018 | Schmidt et al. | |
| 10,051,392 | B2 | 8/2018 | Schmidt et al. | |
| 2005/0125555 | A1 * | 6/2005 | Patel | H04L 69/40 709/238 |
| 2005/0147255 | A1 | 7/2005 | Little | |
| 2006/0159298 | A1 * | 7/2006 | von Dombrowski | H04R 25/48 381/330 |
| 2009/0028364 | A1 | 1/2009 | Vonlanthen | |

(Continued)

FOREIGN PATENT DOCUMENTS

| | | | |
|---|---|---|---|
| DE | 4114921 | A1 | 11/1992 |
| DE | 102006031401 | A2 | 1/2008 |

(Continued)

*Primary Examiner* — Sean H Nguyen
(74) *Attorney, Agent, or Firm* — Birch, Stewart, Kolasch & Birch, LLP

(57) ABSTRACT

The present disclosure relates to detachable speaker units for hearing aid devices, and the hearing aid devices having detachable speaker units. The detachable speaker unit have at least an output transducer for providing a signal perceivable as sound to a user. The detachable speaker unit includes a memory unit storing information relating to characteristics of the output capabilities of the detachable speaker unit, such as transfer function of output transducer and/or transfer function of the entire, or parts of, assembly.

20 Claims, 3 Drawing Sheets

(56) References Cited

U.S. PATENT DOCUMENTS

| | | | | |
|---|---|---|---|---|
| 2009/0103754 | A1 | 4/2009 | Gottschalk et al. | |
| 2012/0288107 | A1* | 11/2012 | Lamm ..... | H04R 25/30<br>381/59 |
| 2014/0205122 | A1 | 7/2014 | Stoffels et al. | |

FOREIGN PATENT DOCUMENTS

| | | | |
|---|---|---|---|
| EP | 2053876 | A1 | 4/2009 |
| EP | 2061274 | A1 | 5/2009 |
| EP | 2 747 394 | A1 | 6/2014 |
| WO | 99/09799 | A2 | 3/1999 |
| WO | 01/69969 | A2 | 9/2001 |

* cited by examiner

HEARING DEVICE WITH DETACHABLE SPEAKER UNIT

FIELD

The present disclosure relates to hearing devices having a speaker unit that may be detached. Further, the present disclosure relates to speaker units that may be removably attached to hearing devices.

BACKGROUND

As the market for 'Receiver in the Ear' (RITE) hearing devices, in particular for hearing aids (HA's), increases, even more RITE modules with different receivers, included in a so-called speaker unit, will come to co-exist in the coming years. A strategy for identifying and distinguishing these RITE modules is needed to ensure that future HA solutions will not impose damage and/or distorted sound and/or produce uncomfortable, i.e. too loud, or too weak, sound levels to the end user in case of attaching to a hearing device a wrong speaker unit, e.g. one with a higher or lower sensitivity than expected during fitting. A mechanical differentiation between different modules is possible, e.g. by having different connectors with different mechanical properties, e.g. form factors, is possible. Such solution is, however, not attractive due to cost of production and the complexity of handling of several different variants of 'the same' component/module.

In practice, each speaker unit will have different physical properties, e.g. frequency response, depending firstly on receiver type and secondly on product variations within a given type. Knowledge of the exact properties, in particular but not limited to the frequency response, of a given receiver can be used to obtain a more precise amplification, possibly without requiring that the type is known in advance. Knowledge of the properties of a particular receiver is useful not only in a hearing device where the receiver is located in a separate body but also in a hearing aid, where the receiver is implemented in the hearing aid-body, e.g. in the same housing as a processing unit.

The present disclosure provides at least an alternative to the prior art.

SUMMARY

The present disclosure relates to hearing devices having speaker units that may be removably attached to the hearing devices, i.e. attached and later detached. This may be useful for various reasons. As a user may need to replace a speaker unit with a similar speaker unit or have a replacement speaker unit with different characteristics, e.g. a larger/smaller receiver, longer connection member. In the present context, the speaker unit is meant to be a unit including at least a receiver, a connection member having a conducting element and a connector for connecting to a hearing device.

According to an aspect the present disclosure provides a hearing device. The hearing device may comprise a hearing device housing including an input transducer, a signal processor adapted to process signal from the input transducer, a hearing device connector. The hearing device may further comprise a detachable speaker unit. The detachable speaker unit may further comprise a connector part having a set of contact pins for contacting the hearing device connector. The detachable speaker unit may further comprise a connecting element having an electrically conductive member, the connecting element connected to the connector part. The detachable speaker unit may further comprise a speaker unit housing configured to be positioned at least partly in the ear canal of the user. The detachable speaker unit may further comprise an output transducer included in the speaker unit housing, the output transducer being configured to provide an acoustic signal based on the processed signal from the signal processor, the speaker unit housing being connected to the connecting element. The detachable speaker unit may further comprise a memory unit arranged in the connector part, the memory unit configured to store data relating to the acoustic properties of the output transducer and/or speaker unit housing. The memory device may comprise information regarding the output transducer so that the hearing device is able to adapt the output signal to achieve an improved audio signal for the user. The types of information as discussed elsewhere in the present disclosure.

According to an aspect, the present disclosure relates to a hearing aid device comprising a hearing aid device housing to be arranged behind the ear of a user. The hearing aid device may include an input transducer, a signal processor adapted to process signal from the input transducer to compensate for the user's hearing loss. The hearing aid may further comprise a hearing device connector. The hearing aid may further be configured to be attached to a detachable speaker unit. The detachable speaker unit may comprise a connector part having a set of contact pins for contacting the hearing device connector. The detachable speaker unit may comprise a connecting element having an electrically conductive member. The connecting element may be connected to the connector part. The detachable speaker unit may comprise a speaker unit housing configured to be positioned at least partly in the ear canal of the user. The detachable speaker unit may comprise an output transducer included in the speaker unit housing, the output transducer may be configured to provide an acoustic signal based on the processed signal from the signal processor. The speaker unit housing may be connected to the connecting element. The detachable speaker unit may comprise a memory unit arranged in the connector part. The memory unit may be configured to store data relating to the acoustic properties of the output transducer and/or speaker unit housing. The detachable speaker unit may comprise a speaker unit input transducer.

The detachable speaker unit may further comprises a speaker unit input transducer. This may be a microphone unit having its primary sound reception directed at the ambient surroundings of the user during use, or having its primary sound reception directed at the ear canal of the user, e.g. so as to pick up own voice of the user and/or detect signal used for feedback compensation and/or reducing occlusion effects or any other purpose. Even further, the detachable speaker unit may further comprises additional speaker unit input transducers, e.g. so that the detachable speaker unit comprises a combination of one or more input transducers picking up ambient sound and one or more input transducers picking up sound from the ear canal. The signal from the one or more input transducers are then forwarded to an appropriate processor for sound processing or other processing.

The memory unit may be configured to provide the stored data to the hearing device upon receiving an interrogation signal from the hearing device. This may e.g. be when the hearing device is powered on, or when the hearing device detects that the detachable speaker unit is attached while the hearing device is powered on, or at any time during use of the hearing device.

The memory unit may be constituted by a micro EEPROM. This could allow the memory unit to have a suitable size for arrangement in the connector.

As mentioned, the memory unit may be configured to store information relating to right/left identification, output transducer-size, length of connecting element, a unique identifier, output transducer calibration data, and/or microphone data or any combination hereof. This will allow the hearing instrument to retrieve relevant data at any point in time as discussed above.

The hearing device connector may comprise a slot and the connector part of the detachable speaker unit comprises a tab mating the slot, the connector part comprises a plurality of contact regions and the hearing device connector comprises a corresponding number of connector arms. The plurality of contact regions constitutes the set of contact pins.

The hearing device connector may comprise a plurality of sockets and the connector part of the detachable speaker unit comprises a corresponding plurality of mating pins.

Advantageously the hearing device may be a hearing aid.

In another aspect the present disclosure relates to a speaker unit for use with a hearing device, the speaker unit being detachable and reconnectable to the hearing device. The speaker unit may comprise a connector part having a set of contact pins for contacting to a hearing device connector. The speaker unit may comprise a connecting element having an electrically conductive member, the connecting element connected to the connector part. The speaker unit may comprise a speaker unit housing configured to be positioned at least partly in the ear canal of the user. The speaker unit may comprise an output transducer included in the speaker unit housing, the output transducer being configured to provide an acoustic signal based on the processed signal from the signal processor. The speaker unit housing may be connected to the connecting element. The speaker unit may comprise a memory unit arranged in the connector part, and the memory unit may be configured to store data relating to the acoustic properties of the output transducer and/or speaker unit housing.

The speaker unit may further comprise an input transducer. This may be a microphone unit having its primary sound reception directed at the ambient surroundings of the user during use, or having its primary sound reception directed at the ear canal of the user, e.g. so as to pick up own voice of the user and/or detect signal used for feedback compensation and/or reducing occlusion effects or any other purpose. Even further, the detachable speaker unit may further comprises additional speaker unit input transducers, e.g. so that the detachable speaker unit comprises a combination of one or more input transducers picking up ambient sound and one or more input transducers picking up sound from the ear canal. The signal from the one or more input transducers are then forwarded to an appropriate processor for sound processing or other processing.

The memory unit may be configured to provide the stored data to the hearing device upon receiving an interrogation signal from the hearing device. This may e.g. be when the hearing device is powered on, or when the hearing device detects that the detachable speaker unit is attached while the hearing device is powered on, or at any time during use of the hearing device.

The memory unit may be constituted by a micro EEPROM. This could allow the memory unit to have a suitable size for arrangement in the connector.

As mentioned, the memory unit may be configured to store information relating to right/left identification, output transducer-size, length of connecting element, a unique identifier, output transducer calibration data, and/or microphone data or any combination hereof. This will allow the hearing instrument to retrieve relevant data at any point in time as discussed above.

The connector part may comprises a tab configured to be received in a slot of the hearing device connector part, the hearing device connector part comprises a plurality of contact regions and the hearing device connector comprises a corresponding number of connector arms.

The hearing device connector may comprises a plurality of sockets and the connector part of the detachable speaker unit comprises a corresponding plurality of mating pins.

The detachable speaker unit is advantageously configured to use with a hearing aid.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 1:
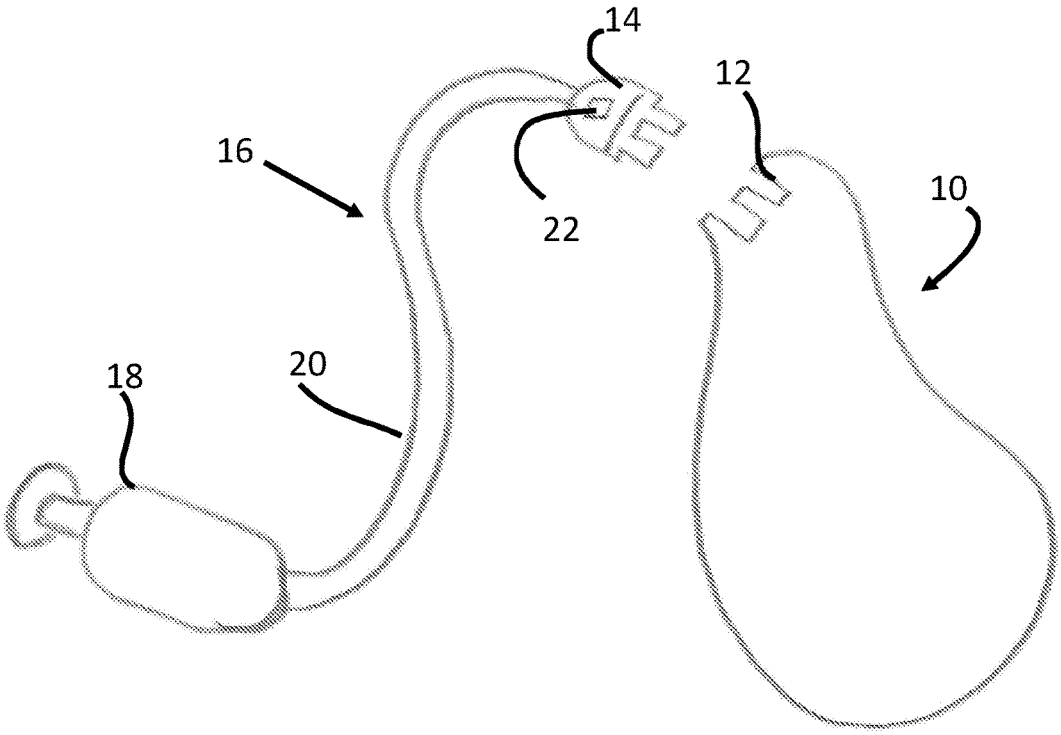
FIG. 1 illustrates a speaker unit and a hearing device.

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. Such audible signals may be provided in the form of an acoustic signal radiated into the user's outer ear.

The hearing device is adapted to be worn by arranging a unit of the hearing device behind the ear with a receiver/loudspeaker arranged close to or in the ear canal such as in a Behind-the-Ear type hearing aid.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefiting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

Now referring to FIG. 1, which schematically illustrates a hearing device 10 having a connector part 12 configured to establish contact to a mating connector part 14 of a speaker unit 16. The hearing device 10 comprises an input transducer, not illustrated here, for receiving ambient sound and converting it to an electrical signal. The electrical signal is processed in the hearing device 10 by a signal processor, not illustrated, so as to compensate for a users hearing loss. The processor provides an processed signal. The processing usually comprises one or more of frequency dependent amplification, frequency transpositioning, frequency compression, filtering etc.

The speaker unit 16 comprises a receiver 18, which is configured to be positioned at or at least partly in an ear canal of a user. The receiver 18 provides an acoustical output signal based on the processed signal. A connecting element 20 connects the connector part 14 and the receiver 18. The connecting element 20 comprises a number of conductors. As illustrated later the number of conductors could be three, or even more.

As there is no standard size cars for humans, a variety of lengths of connecting element 20 may be provided, e.g. as a set of connecting elements 20 from which a best match is chosen. Further, not all users have the same need for types of receiver 18, some users may need a high sound pressure level in order to hear, whereas others does not require the same level.

For ensuring that the hearing device 10 outputs a suitable signal to the user, a paring of the speaker unit 16 and the hearing device 10 is advantageous. For this purpose a memory device 22, here in the form of a micro-EEPROM is provided. The memory device 22 is illustrated as being positioned in the connector part 14, i.e. the plug, as it reduces the need for additional conductors in the connecting element 20 needed to communicate with the memory device 22 to/from the hearing device 10.

When the speaker unit 16 is attached to the hearing device 10, the electrical connection via the connecting element 20 enables the hearing device 10 to read from the memory unit 22. Besides providing identification information, such as speaker type, and possibly left/right speaker unit identification, the memory unit 22 is able to store information regarding speaker unit size and/or wire length, receiver calibration data, e.g. specifically measured transfer function/frequency response for the particular speaker unit, microphone data to improve directional performance. These data may be read by the hearing device 10 from the memory device 22. The data may be read each time the hearing device 10 is powered on, but if the hearing device 10 is able to detect that the speaker unit 16 has been detached in the period where the hearing device 10 was not in operation, the need to read the data is lessened. The hearing device 10 preferably stores the last know speaker unit 16 connected to the hearing device 10. The hearing device 10 may then only confirm the identity of the speaker unit, e.g. by reading only part of the data stored in the memory device, thereby shortening the time needed to read data. This could for instance be unique identification data.

By the hearing device 10 knowing specifics about the receiver 18 the processor is able to more accurately take into considerations about the transfer function of that particular receiver 18, thereby increasing the acoustic performance for the user.

The memory device 22 is a single-wired, I/O powered serial EEPROM which is configured so that it will not take up much space in the connector part 14. Compared to a plug not having such a memory device, the plug, connector part 14, needs at least one extra pin so that the data may be accessed. The memory device 14 may be positioned at the other end of the spear unit 16, i.e. near the receiver 18. This, however, requires an extra wire in the connecting element 20

Figure 2:
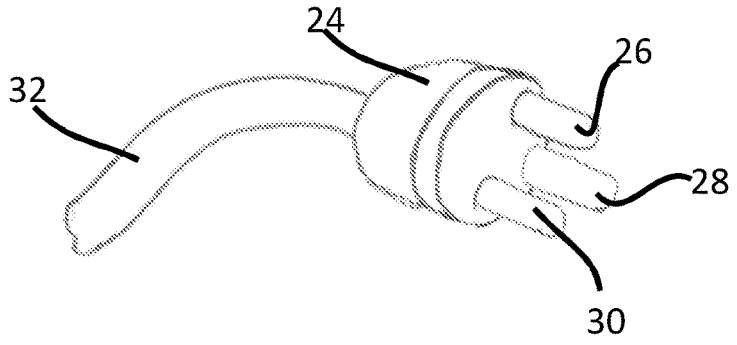
FIG. 2 illustrates connector part of a speaker unit.

FIG. 2 is a schematic illustration of a connector part 24 having three contact pins 26, 28 and 30. The contact pins 26, 28 and 30 are formed so as to mate with corresponding socket in a hearing device. Corresponding litz wires are arranged in the connecting element 32.

Figure 3:
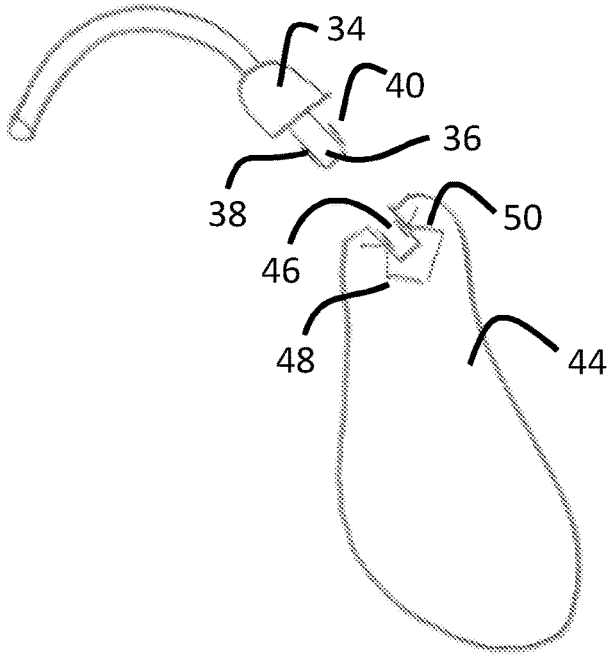
FIG. 3 illustrates a speaker unit and a hearing device.
Figure 4:
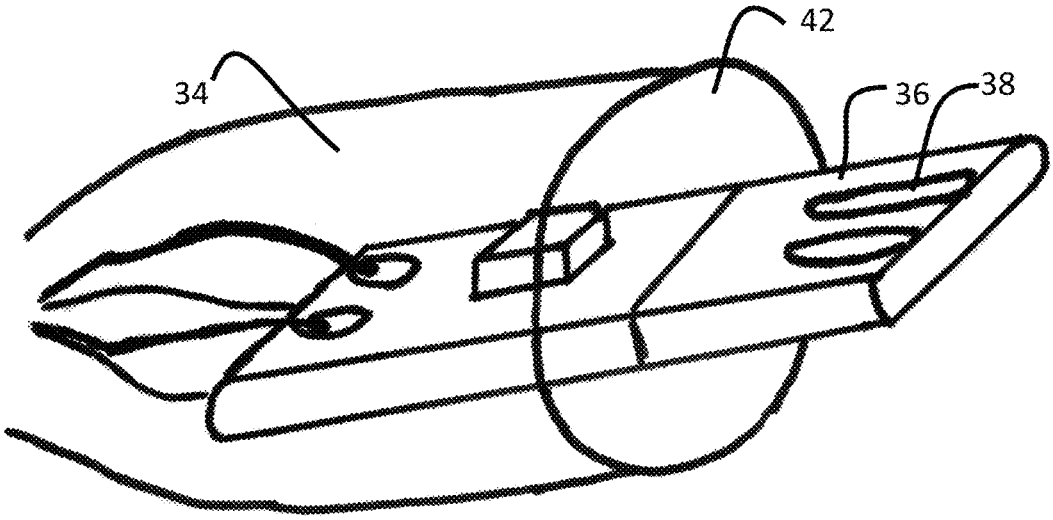
FIG. 4 illustrates a tab of a connector.

FIG. 3 is a schematic illustration of a connector part 34, where a tab 36 extends or projects from the connector 34. The tab 36 is shown as having a partial rectangular geometry, but other geometries could be envisioned. The tab 36 may be characterized as a strip of material extending or projecting from the connector. The tab 36 have electrically conductive areas 38 and 40 on two sides. In other cases, the tab 36 includes only electrically conductive areas on one side. The lab 36 is here a printed circuit board. FIG. 4 is a schematic zoomed view where part of the tab 36 inside the connector part 34. In FIG. 4 it is seen that part of the tab 36 extends perpendicular to a surface 42 of the connector part 34.

FIG. 3 further schematically illustrates that the hearing device 44 comprises a socket 46 having a number of conducting arms, here seen with the reference numerals 48 and 50, configured to establish electrical connection to the electrically conductive areas 38 and 40. The number of conducting arms match the number of conductive areas, however, in case the conductive areas on the tab are only present on one side the number of conducting arms in the socket may be either the same or double, so that the tab could be inserted in either orientation. Presently it is preferred that there is only one way of inserting the plug into the socket. The conducting arms 48 and 50 act as spring-like elements which are pressed into a firm position when then tab 36 is inserted. When not loaded by the presence of a tab 36, the conducting arms 48 and 50 have some degree of movement, limited by a grating or combed structure ensuring that the arms do not move into a neighboring area.

On the tab 36, a memory device 37 is positioned. The part of the tab 36 including the memory device 37 is embedded in a plastic part constituting the main part of the connector part 34. Litz wires are attached to the tab 36 to establish electrical connection to a receiver.

Figure 5:
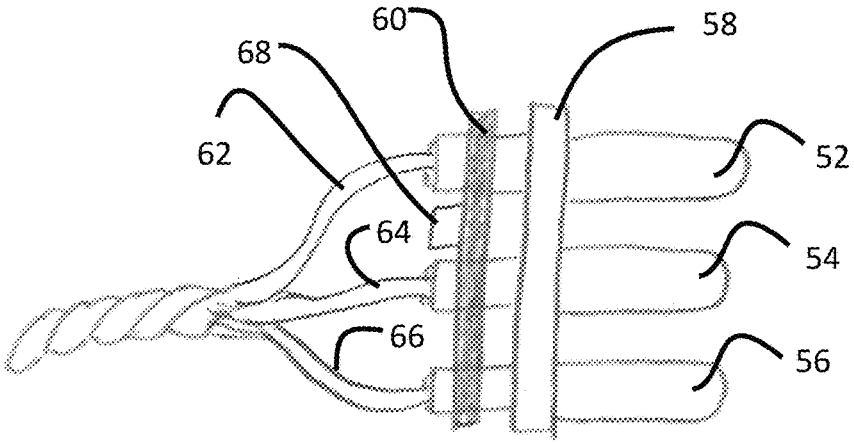
FIG. 5 illustrates a connector having three pins.

FIG. 5 schematically illustrate the inside of a plug or connector part of the same type as illustrated in FIGS. 1 and 2. Here three contact pins 52, 54 and 56 are fixated by a part 58 made from plastic. Other non-conductive/electrically insulating material may be used.

A PCB 60, printed circuit board, holds the contact pins 52, 54 and 56. The contact pins 52, 54 and 56 are connected to respective litz wire 62, 64, 66. The litz wires 62, 64, 66 are coated to protect and keep the wires assembled. A memory device 68 is attached to one side of the PCB 60. Here it is shown that the memory device 68 is attached opposite the side facing the hearing device during use. It is possible to place the memory device elsewhere, e.g. at the side near the hearing device during use.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A hearing aid device comprising:

a hearing aid device housing to be arranged behind the ear of a user, the hearing aid device including an input transducer, a signal processor adapted to process signal from the input transducer to compensate for the user's hearing loss, a hearing device connector, and a detachable speaker unit connected to the hearing device connector of the hearing aid device housing and comprising a connector part having a set of contact pins for plugging into and contacting the hearing device connector, a connecting element having an electrically conductive member, the connecting element connected to the connector part, a speaker unit housing configured to be positioned at least partly in the ear canal of the user, an output transducer included in the speaker unit housing, the output transducer being configured to provide an acoustic signal based on the processed signal from the signal processor, the speaker unit housing being connected to the connecting element, a memory unit arranged in the connector part and connected to at least one contact pin of the set of contact pins in the connector part, the memory unit configured to store data of a measured transfer function or a measured frequency response of the output transducer, wherein the stored data in the memory unit is transferred to the signal processor, via the at least one contact pin and a conductive element in the hearing device connector, for use in adapting at least one of the following types of processing applied to the signal: frequency dependent amplification, frequency transpositioning, frequency compression, and filtering.

2. The hearing aid device according to claim 1, wherein the detachable speaker unit further comprises a speaker unit input transducer.

3. The hearing aid device according to claim 2 wherein the memory unit is configured to provide the stored data to the hearing device upon receiving an interrogation signal from the hearing device.

4. The hearing aid device according to claim 2, wherein the memory unit is a micro EEPROM.

5. The hearing aid device according to claim 2, wherein the memory unit is configured to store right/left identification, output transducer-size, length of connecting element, a unique identifier, output transducer calibration data, and/or microphone data.

6. The hearing aid device according to claim 1, wherein the memory unit is configured to provide the stored data to the hearing device upon receiving an interrogation signal from the hearing device.

7. The hearing aid device according to claim 6, wherein the memory unit is a micro EEPROM.

8. The hearing aid device according to claim 6, wherein the memory unit is configured to store right/left identification, output transducer-size, length of connecting element, a unique identifier, output transducer calibration data, and/or microphone data.

9. The hearing aid device according to claim 1, wherein the memory unit is a micro EEPROM.

10. The hearing aid device according to claim 1, wherein the memory unit is configured to store right/left identification, output transducer-size, length of connecting element, a unique identifier, output transducer calibration data, and/or microphone data.

11. The hearing aid device according to claim 1, wherein the hearing device connector comprises a slot and the connector part of the detachable speaker unit comprises a tab mating the slot, the connector part comprises a plurality of contact regions and the hearing device connector comprises a corresponding number of connector arms.

12. The hearing aid device according to claim 1, wherein the hearing device connector comprises a plurality of sockets and the connector part of the detachable speaker unit comprises a corresponding plurality of mating pins.

13. A detachable speaker unit configured for use with a hearing aid device having a housing configured to be positioned behind the ear of a wearer, the speaker unit being detachable and reconnectable to a hearing device connector of the hearing aid device, the speaker unit comprising:

a connector part having a set of contact pins for plugging into and contacting to a hearing device connector, a connecting element having an electrically conductive member, the connecting element connected to the connector part, a speaker unit housing configured to be positioned at least partly in the ear canal of the user, an output transducer included in the speaker unit housing, the output transducer being configured to provide an acoustic signal based on a processed signal from a signal processor in the hearing aid device, the speaker unit housing being connected to the connecting element, and a memory unit arranged in the connector part and connected to at least one contact pin of the set of contact pins in the connector part, the memory unit configured to store data of a measured transfer function or a measured frequency response of the output transducer, wherein the stored data in the memory unit is transferred to the signal processor, via the at least one contact pin and a conductive element in the hearing device connector, for use in adapting at least one of the following types of processing applied to the signal: frequency dependent amplification, frequency transpositioning, frequency compression, and filtering.

14. The detachable speaker unit according to claim 13, further comprising an input transducer.

15. The detachable speaker unit according to claim 13, wherein the memory unit is configured to provide the stored data to the hearing device upon receiving an interrogation signal from a hearing aid device.

16. The detachable speaker unit according to claim 15, wherein the stored data is transmitted to the hearing aid device via the electrically conductive member.

17. The detachable speaker unit according to claim 13, wherein the memory unit is a micro EEPROM.

18. The detachable speaker unit according to claim 13, wherein the memory unit is configured to store right/left identification, output transducer-size, length of connecting element, a unique identifier, output transducer calibration data, and/or microphone data.

19. The detachable speaker unit according to claim 13, wherein the connector part comprises a tab configured to be received in a slot of the hearing device connector part, the hearing device connector part comprises a plurality of contact regions and the hearing device connector comprises a corresponding number of connector arms.

20. The detachable speaker unit according to claim 13, wherein the hearing device connector comprises a plurality of sockets and the connector part of the detachable speaker unit comprises a corresponding plurality of mating pins.

* * * * *